US011208995B2

(12) United States Patent
Mou et al.

(10) Patent No.: US 11,208,995 B2
(45) Date of Patent: Dec. 28, 2021

(54) MICRO PIEZOELECTRIC PUMP MODULE

(71) Applicant: MICROJET TECHNOLOGY CO., LTD., Hsinchu (TW)

(72) Inventors: Hao-Jan Mou, Hsinchu (TW); Shen-Wen Chen, Hsinchu (TW); Shih-Chang Chen, Hsinchu (TW); Chi-Feng Huang, Hsinchu (TW); Yung-Lung Han, Hsinchu (TW); Wei-Ming Lee, Hsinchu (TW); Chun-Yi Kuo, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 0 days.

(21) Appl. No.: 16/834,204

(22) Filed: Mar. 30, 2020

(65) Prior Publication Data

US 2020/0318633 A1 Oct. 8, 2020

(30) Foreign Application Priority Data

Apr. 3, 2019 (TW) ..... 108112036

(51) Int. Cl.
*F04B 49/06* (2006.01)
*F04B 43/04* (2006.01)

(52) U.S. Cl.
CPC ..... *F04B 49/06* (2013.01); *F04B 43/046* (2013.01)

(58) Field of Classification Search
CPC ..... F04B 43/046; F04B 49/06
See application file for complete search history.

(56) References Cited

U.S. PATENT DOCUMENTS 6,481,984 B1 * 11/2002 Shinohara ..... F04B 43/046 417/413.2
7,679,262 B2 * 3/2010 Meng ..... H02N 2/14 310/317
9,618,585 B2 * 4/2017 Hu ..... H02M 3/33515
10,680,157 B2 * 6/2020 Chen ..... H01L 41/042
2005/0219288 A1 * 10/2005 Vogeley ..... F04B 43/046 347/10
2009/0015097 A1 * 1/2009 Meng ..... F04B 43/046 310/317
2012/0046520 A1 * 2/2012 Augarten ..... A61F 5/005 600/37

(Continued)

*Primary Examiner* — Patrick Hamo
(74) *Attorney, Agent, or Firm* — McClure, Qualey & Rodack, LLP

(57) ABSTRACT

A micro piezoelectric pump module includes a microprocessor, a driving element, and a piezoelectric pump. The driving element is connected to the microprocessor to receive a modulating signal and a control signal and to output a driving signal. The driving signal includes a driving voltage and a driving frequency. The piezoelectric pump is actuated by the driving signal, and the piezoelectric pump is set to be actuated at an actuation frequency and be applied with an actuation voltage value. The microprocessor drives the driving element to output the driving voltage having an initial voltage value at the driving frequency to the piezoelectric pump, and adjusts the driving frequency to the same with the actuation frequency. After the driving frequency is adjusted to reach the actuation frequency, the microprocessor drives the driving element to gradually increase the initial voltage value to reach the actuation voltage value.

13 Claims, 4 Drawing Sheets

(56) References Cited

U.S. PATENT DOCUMENTS

| | | | | |
|---|---|---|---|---|
| 2015/0022056 | A1* | 1/2015 | Glaser | H02M 3/33584 310/316.01 |
| 2015/0094602 | A1* | 4/2015 | Yamashita | A61B 5/02233 600/494 |
| 2015/0337828 | A1* | 11/2015 | Refai-Ahmed | F04B 43/04 417/45 |
| 2018/0106245 | A1* | 4/2018 | Chen | F04B 35/045 |
| 2018/0108825 | A1* | 4/2018 | Chen | F04B 49/065 |
| 2019/0234838 | A1* | 8/2019 | Mou | G01N 33/0009 |
| 2020/0240400 | A1* | 7/2020 | Mou | F04B 23/06 |

* cited by examiner

MICRO PIEZOELECTRIC PUMP MODULE

CROSS-REFERENCE TO RELATED APPLICATION

This non-provisional application claims priority under 35 U.S.C. § 119(a) to Patent Application No. 108112036 filed in Taiwan, R.O.C. on Apr. 3, 2019, the entire contents of which are hereby incorporated by reference.

BACKGROUND

Technical Field

The present disclosure relates to a micro piezoelectric pump module. In particular, to a micro piezoelectric pump module that may reduce the noise generated when the micro piezoelectric pump is switched on and off, and may constantly maintain a better transmission efficiency.

Related Art

Nearly every product in various industries is developing toward miniaturization, and micro pumps are the key points to fluid transmission devices. Therefore, how to make micro pumps small, quiet and have good fluid transport efficiency is a topic of the current technology industry. FIGS. 1A and 1B show a micro piezoelectric pump structure known to the inventors. A driving voltage is applied to the piezoelectric element 201 of the micro piezoelectric pump 200, and then the piezoelectric element 201 is deformed due to the piezoelectric effect. The vibration plate 202 and the resonance plate 203 are further driven to move upward and downward by the deformation of the piezoelectric element 201. When the vibration plate 202 and the resonance plate 203 are moved upward and downward, the volume of the internal cavity of the piezoelectric pump 200 is compressed and expanded, so that the pressure inside the piezoelectric pump 200 is changed correspondingly. Thereby, the effect of fluid transmission is achieved.

Current micro piezoelectric pumps have been widely used in various fields as important components for fluid transmission, such as in medical sphygmomanometers, blood glucose meters, or air detection devices that detect air quality. Moreover, along with the miniaturization of the micro piezoelectric pump, the total size of each product can be reduced, so that the product can be carried with more conveniently.

However, in the aforementioned applications, most of the micro piezoelectric pumps are operated intermittently. For example, blood pressure monitors and blood glucose meters are only switched on when they are used. The air detection devices also perform intermittent sampling operations at intervals, but not in a continuous operation. Thus, the current micro piezoelectric pump will generate short noises when the pump is switched on and off. Especially in an air detection device, if the air detection device is set to perform gas sampling every 10 minutes, the pump will make noise twice every 10 minutes when the device is switched on and off. With shortening the sampling time and increasing the sampling frequency, the noise generated during the on-off operation of the micro piezoelectric pump will interfere the daily life of a user. In particular, when a user is falling asleep at night, frequent noise would seriously affect the user's sleep quality.

SUMMARY

In general, the main purpose of present application is to provide a micro piezoelectric pump module, which can effectively reduce the noise of the micro piezoelectric pump when the pump is switched on and off.

To achieve the above mentioned purpose, the general embodiment of the present application provides a micro piezoelectric pump module including a microprocessor, a driving element, and a piezoelectric pump. The microprocessor outputs a modulating signal and a control signal. The driving element is electrically connected to the microprocessor to receive the modulating signal and the control signal and to output a driving signal. The driving signal comprises a driving voltage and a driving frequency. The piezoelectric pump is electrically connected to the driving element to receive the driving signal. The piezoelectric pump is actuated by the driving signal. The piezoelectric pump is set to be applied with an actuation voltage value and be actuated at an actuation frequency. Then, after receiving a switch-on signal, the microprocessor drives the driving element to output the driving voltage having an initial voltage value to the piezoelectric pump, and the microprocessor makes the driving element gradually adjust the driving frequency of the driving voltage to be the same with the actuation frequency. After the driving frequency is adjusted to reach the actuation frequency, the microprocessor drives the driving element to gradually increase the initial voltage value to reach the actuation voltage value.

BRIEF DESCRIPTION OF THE DRAWINGS

The disclosure will become more fully understood from the detailed description given herein below for illustration only, and thus not limitative of the disclosure, wherein.

DETAILED DESCRIPTION

Embodiments embodying the features and advantages of the present application will be described in detail in the description of the following paragraphs. It should be understood that the present application may have various changes in different aspects, all of which do not depart from the claimed scope of the present application, and the descriptions and figures therein are essentially for the purpose of illustration, rather than limiting the present application.

Figure 1A:
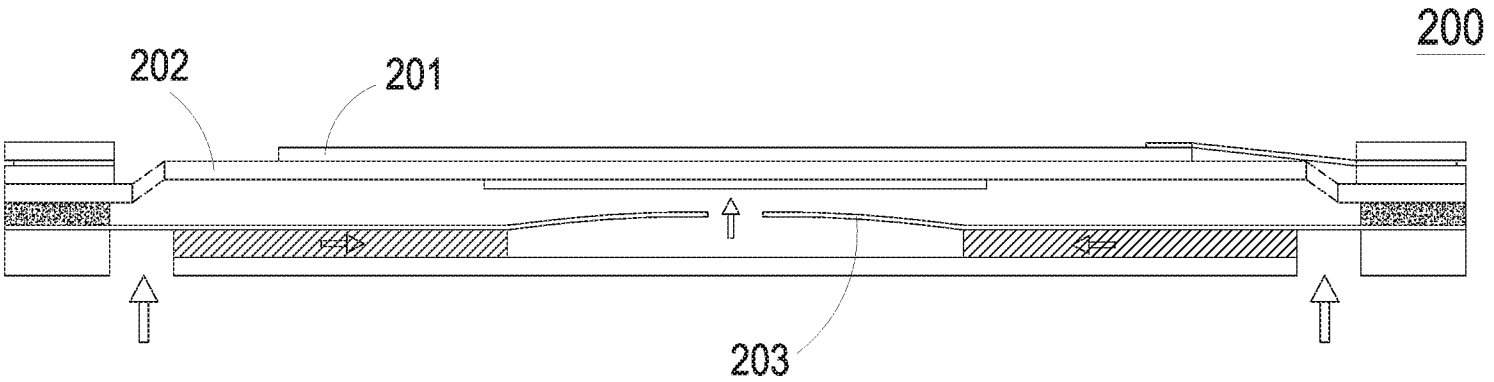
FIG. 1A (PRIOR ART)
FIG. 1A and FIG. 1B illustrate cross-sectional views of a micro piezoelectric pump known to the inventors at different operation steps.
Figure 1B:
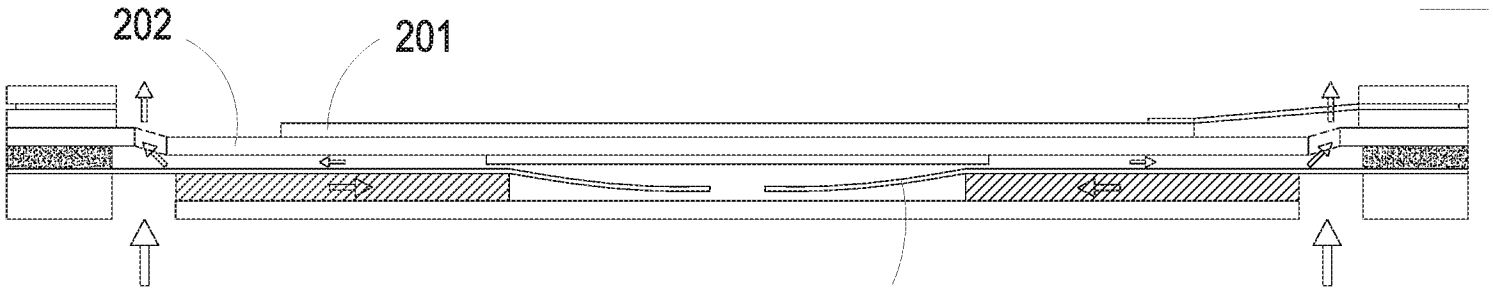
FIG. 1B (PRIOR ART)
Figure 2:
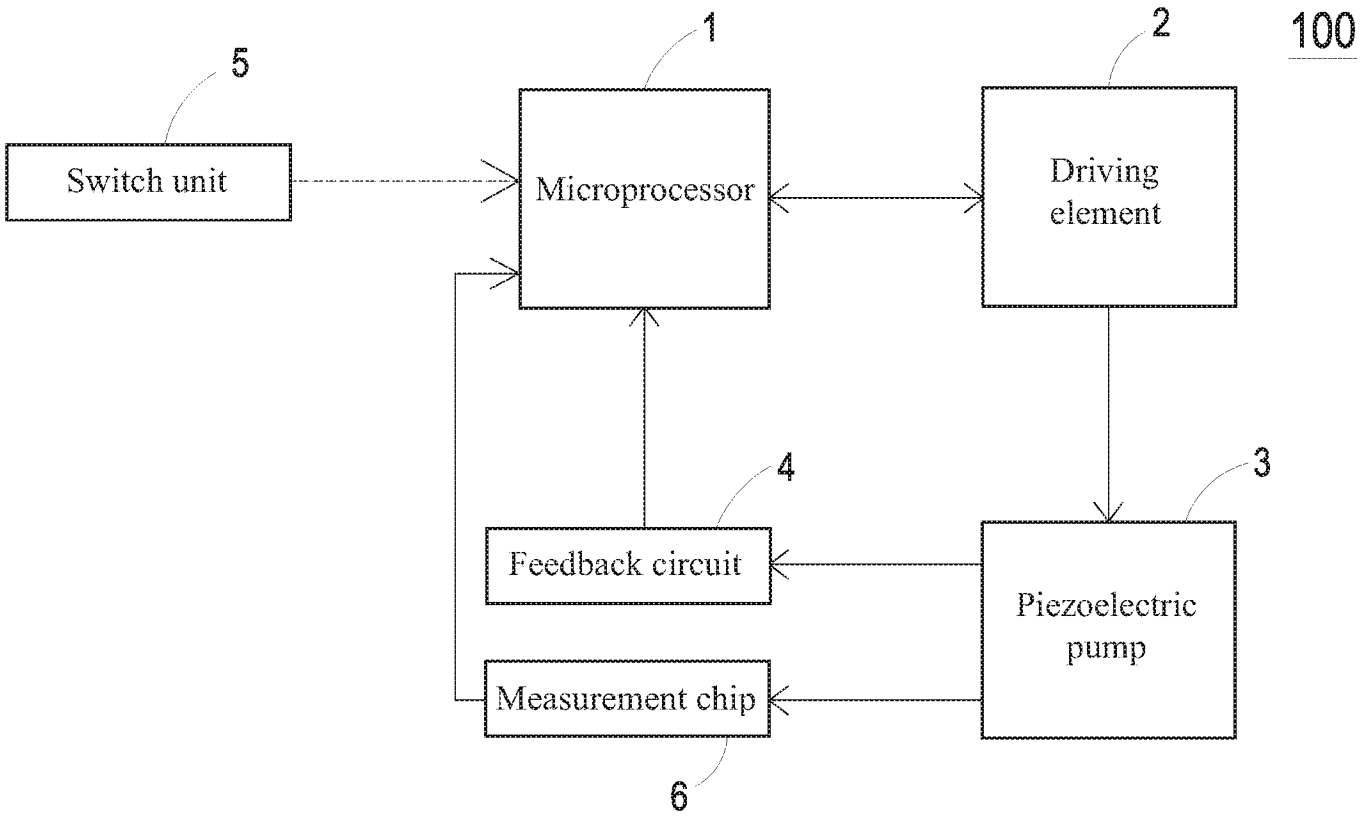
FIG. 2 illustrates a block diagram of a micro piezoelectric pump module according to an exemplary embodiment of the present disclosure.

Please refer to FIG. 2. FIG. 2 illustrates a block diagram of a micro piezoelectric pump module according to an exemplary embodiment of the present application. The micro piezoelectric pump module 100 includes a microprocessor 1, a driving element 2, and a piezoelectric pump 3. The microprocessor 1 is used to output a modulating signal and a control signal. The driving element 2 is electrically connected to the microprocessor 1 so as to receive the modulating signal and the control signal, and to output a driving signal according to the modulating signal and the control signal. The microprocessor 1 drives the driving element 2 to convert a constant voltage into the driving signal. The driving signal includes a driving voltage and a driving frequency. In the exemplary embodiment of the present application, the driving signal is a square wave alternating current (so it includes the driving voltage and the driving frequency), but is not limited thereto. The driving signal may also be a sine wave or a triangular wave. The driving element 2 adjusts the driving voltage according to the modulating signal of the microprocessor 1, and adjusts the driving frequency according to the control signal of the microprocessor 1, thereby driving the piezoelectric pump 3 to operate. The piezoelectric pump 3 is electrically connected to the driving element 2 to receive the driving signal transmitted by the driving element 2, and to be operated according to the driving signal. Moreover, the piezoelectric pump 3 has an actuation frequency and a value of an actuation voltage (may be referred to an actuation voltage value). The piezoelectric pump 3 does not start to operate until the driving frequency received by the piezoelectric pump 3 is raised to reach the actuation frequency. That is, the piezoelectric pump 3 may operate when the applied actuation voltage is applied with the actuation frequency. The actuation voltage value is an ideal working voltage of the piezoelectric pump 3. When the voltage value of the driving voltage received by the piezoelectric pump 3 is consistent with the actuation voltage value, the piezoelectric pump 3 has a better transmission efficiency.

The microprocessor 1 is adapted to be electrically connected to a switch unit 5 to receive a switch-on signal and a switch-off signal from the switch unit 5. When the microprocessor 1 receives the switch-on signal from the switch unit 5, the microprocessor 1 outputs the modulating signal to the driving element 2 so as to drive the driving element 2 to adjust the constant voltage to an initial voltage value. Then, the driving element 2 outputs a driving voltage with the initial voltage value to the piezoelectric pump 3, and outputs the driving voltage at a driving frequency to the piezoelectric pump 3. By adjusting the control signal, the microprocessor 1 adjusts the driving frequency of the driving voltage output by the driving element 2, and thus the driving frequency is gradually adjusted to be the same with the actuation frequency of the piezoelectric pump 3 when the driving element 2 outputs the driving voltage with the initial voltage value to the piezoelectric pump 3. When the driving frequency output by the driving element 2 is consistent with the actuation frequency, the piezoelectric pump 3 immediately starts to operate, and the microprocessor 1 adjusts the voltage value of the driving voltage of the driving element 2 again through the modulating signal, so as to drive the driving voltage value output by the driving element 2 to gradually increase from the initial voltage value to reach the actuation voltage value. Thus, the starting operation can be completed.

Following the previous disclosure, when the microprocessor 1 receives the switch-off signal, the microprocessor 1 outputs a modulating signal to the driving element 2 so as to drive the driving element 2 to gradually decrease the voltage value of the driving voltage output to the piezoelectric pump 3 to reach a switch-off voltage value. When the voltage value of the driving voltage drops to the switch-off voltage value, the microprocessor 1 stops outputting the modulating signal and the control signal to the driving element 2 to stop the driving element 2, and thus the operation of the piezoelectric pump 3 is turned off by the microprocessor 1 simultaneously. Moreover, the above-mentioned switch-off voltage value may be the same as the initial voltage value, but is not limited thereto.

Figure 3:
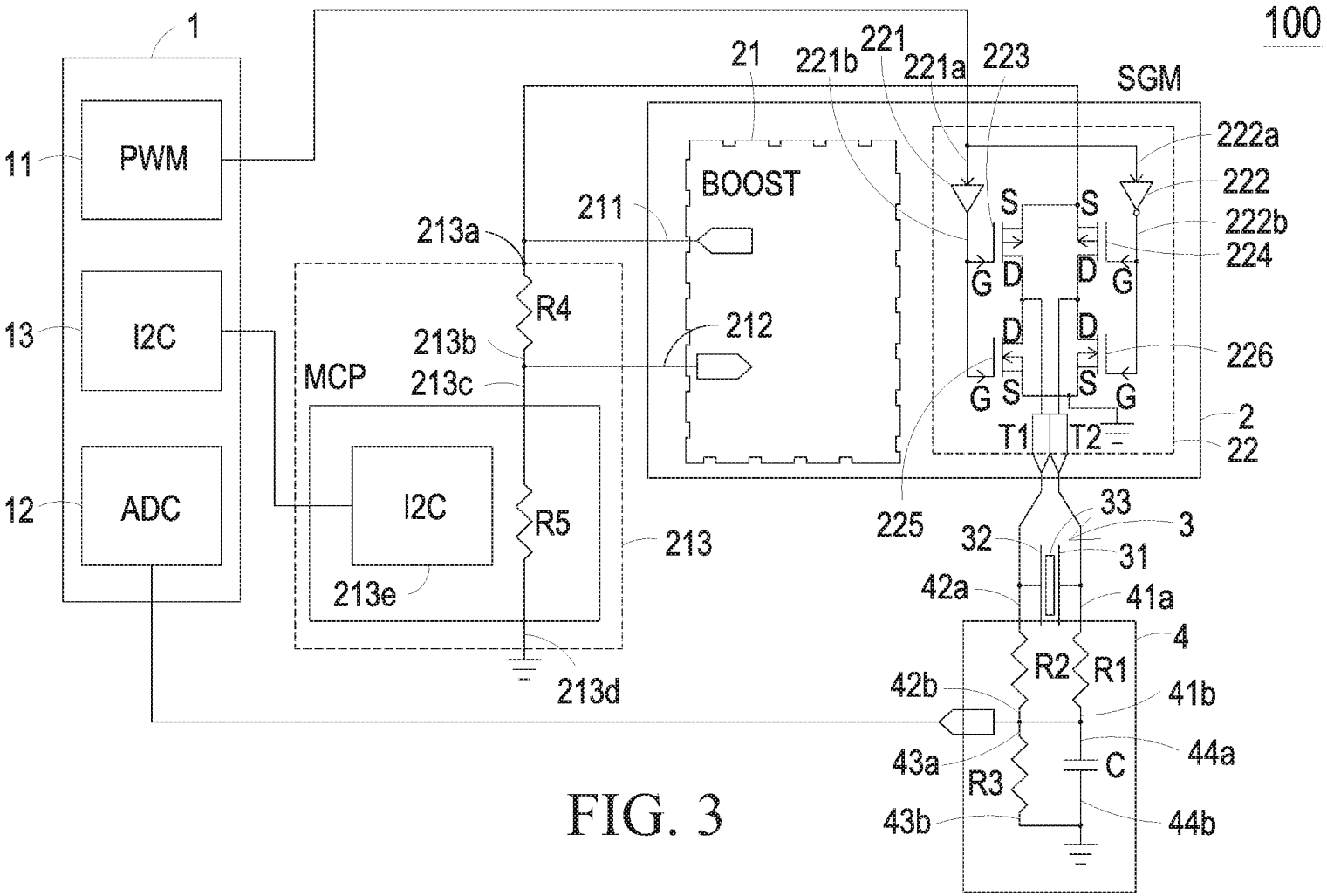
FIG. 3 illustrates a schematic circuit diagram of the micro piezoelectric pump module according to an exemplary embodiment of the present disclosure.

Please refer to FIG. 3. FIG. 3 illustrates a schematic circuit diagram of the micro piezoelectric pump module according to the exemplary embodiment of the present disclosure. In the exemplary embodiment, the microprocessor 1 includes a control unit 11, a conversion unit 12, and a communication unit 13. The driving element 2 includes a transforming element 21 and an inverting element 22. The piezoelectric pump 3 includes a first electrode 31, a second electrode 32, and a piezoelectric element 33. The communication unit 13 is electrically connected to the transforming element 21 so as to output the modulating signal to the transforming element 21. The transforming element 21 modulates a constant voltage to a needed driving voltage according to the modulating signal, and then outputs the driving voltage to the piezoelectric pump 3. The control unit 11 is electrically connected to the inverting element 22. The inverting element 22 controls the driving frequency of the needed driving voltage, and thus the need driving voltage may be applied with the driving frequency. Through the driving frequency output by the inverting element 22, the control unit 11 controls the frequency of grounding or not grounding. More specifically, there are two conduction modes switched therebetween. When the first electrode 31 receives the driving voltage, the second electrode 32 is grounded; and when the second electrode 32 receives the driving voltage, the first electrode 31 is grounded. Such switching frequency may be subtly handled by the inverting element 22. Owing to the switching conduction modes, the switching speed of the deformation of the piezoelectric element 33 due to the piezoelectric effect can be further controlled.

In the exemplary embodiment, the transforming element 21 further includes a voltage output end 211, a transformer feedback end 212, and a transformer feedback circuit 213. The voltage output end 211 is electrically connected to the inverting element 22. The transformer feedback circuit 213 is electrically connected between the microprocessor 1 and the transformer feedback end 212. The transformer feedback circuit 213 includes a fourth resistor R4 and a fifth resistor R5. The fourth resistor R4 has a first end 213*a* and a second end 213*b*. The fifth resistor R5 has a third end 213*c* and a fourth end 213*d*. The first end 213*a* of the fourth resistor R4 is electrically connected to the voltage output end 211, and the third end 213*c* of the fifth resistor R5 is electrically connected to the second end 213*b* of the fourth resistor R4 and the transformer feedback end 212. The fourth end 213*d* of the fifth resistor R5 is grounded. The fifth resistor R5 is a variable resistor. In this embodiment, the fifth resistor R5 is a digital variable resistor. The transformer feedback circuit 213 has a communication interface 213*e*, and the communication interface 213*e* is electrically connected to the communication unit 13 of the microprocessor 1, so as to allow the communication unit 13 to transmit a modulating signal to the digital variable resistor (the fifth resistor R5) to adjust the resistance value of the fifth resistor R5. Moreover, the driving voltage output from the voltage output end 211 of the transforming element 21 is also divided by the fourth resistor R4 and the fifth resistor R5 of the transformer feedback circuit 213. Then, the divided driving voltage is transmitted back to the transforming element 21 through the transformer feedback end 212 for the transforming element 21 to refer whether the output driving voltage is consistent with the driving voltage expected to the modulating signal of the microprocessor 1. If there is a difference between the output driving voltage and the driving voltage expected to the modulating signal of the microprocessor 1, then the output driving voltage is modulated again. The output driving voltage is adjusted continuously so as to approach closer to reach the driving voltage expected to the modulating signal of the microprocessor 1, and the output driving voltage is made consistent with the expected driving voltage.

The inverting element 22 includes a buffer gate 221, a phase inverter 222, a first P-type metal-oxide-semiconductor field-effect transistor (MOSFET) 223, a second P-type MOSFET 224, a first N-type MOSFET 225, and a second N-type MOSFET 226. The buffer gate 221 has a buffer input end 221*a* and a buffer output end 221*b*. The phase inverter 222 has an inverting input end 222*a* and an inverting output end 222*b*. Each of the first P-type MOSFET 223, the second P-type MOSFET 224, the first N-type MOSFET 225, and the second N-type MOSFET 226 has a gate G, a drain D, and a source S, respectively. The buffer input end 221*a* of the buffer gate 221 and the inverting input end 222*a* of the phase inverter 222 are electrically connected to the control unit 11 of the microprocessor 1 to receive the control signal. The buffer output end 221*b* of the buffer gate 221 is electrically connected to the gate G of the first P-type MOSFET 223 and the gate G of the first N-type MOSFET 225. The inverting output end 222*b* of the phase inverter 222 is electrically connected to the gate G of the second P-type MOSFET 224 and the gate G of the second N-type MOSFET 226. The source S of the first P-type MOSFET 223 and the source S of the second P-type MOSFET 224 are electrically connected to the voltage output end 211 of the transforming element 21 to receive the driving voltage output by the transforming element 21. The drain D of the first P-type MOSFET 223 is electrically connected to the drain D of the first N-type MOSFET 225 and the second electrode 32 of the piezoelectric pump 3. The drain D of the second P-type MOSFET 224 is electrically connected to the drain D of the second N-type MOSFET 226 and the first electrode 31 of the piezoelectric pump 3. The source S of the first N-type MOSFET 225 is electrically connected to the source S of the second N-type MOSFET 226 and then grounded.

The aforementioned first P-type MOSFET 223, the second P-type MOSFET 224, the first N-type MOSFET 225, and the second N-type MOSFET 226 form an H-bridge structure, which is used to convert the driving voltage in DC output by the transformer 21 into AC, so as to make the driving signal be an alternating current with a driving voltage and a driving frequency and then be transmitted to the piezoelectric pump 3. Therefore, the first P-type MOSFET 223 and the second P-type MOSFET 224 need to receive opposite-phase signals respectively, and so do the first P-type MOSFET 225 and the second N-type MOSFET 226. Therefore, the control signal transmitted from the microprocessor 1 is configured to be transmitted through the phase inverter 222 before transmitting to the second P-type MOSFET 224, and thus the phase of the control signal of the second P-type MOSFET 224 is opposite to the phase of the control signal of the first P-type MOSFET 223. However, the first P-type MOSFET 223 and the second P-type MOSFET 224 should receive the control signals simultaneously. Thus, the buffer gate 221 is provided before the first P-type MOSFET 223, so that the first P-type MOSFET 223 and the second P-type MOSFET 224 may receive the opposite-phase signals synchronously. The first N-type MOSFET 225 and the second N-type MOSFET 226 is operated in a similar way as well. In the first control step, the first P-type MOSFET 223 and the second N-type MOSFET 226 are in an on-state; the second P-type MOSFET 224 and the first N-type MOSFET 225 are in an off-state. Under such circumstance, the driving voltage will be transmitted to the second electrode 32 of the piezoelectric pump 3 through the first P-type MOSFET 223; conversely, the first electrode 31 of the piezoelectric pump 3 is grounded due to the second N-type MOSFET 226 is in the on-state. In second control step, the first P-type MOSFET 223 and the second N-type MOSFET 226 are in the off-state; the second P-type MOSFET 224 and the first N-type MOSFET 225 are in the on-state. Under such circumstance, the driving voltage will be transmitted to the first electrode 31 of the piezoelectric pump 3 through the second P-type MOSFET 224; conversely, the second electrode 32 of the piezoelectric pump 3 is grounded due to the first N-type MOSFET 225 is in the on-state. By repeating the above first step and second step, the piezoelectric element 33 of the piezoelectric pump 3 can be deformed through the piezoelectric effect which is caused, by configuring the first electrode 31 and the second electrode 32 to alternately receive the driving voltage and to be grounded. Moreover, the direction of deformation of the piezoelectric element 33 is changed depending on the driving frequency, and thus the volume of the chamber (not shown) inside the piezoelectric pump 3 will be further changed correspondingly, so that the pressure in the chamber is changed to continuously push the fluid, thereby achieving the effect of fluid transmission.

Please still refer to the FIG. 2. The above disclosure has explained how the microprocessor 1 control the driving element 2 to output the driving voltage and driving frequency to the piezoelectric pump 3. However, since the piezoelectric element 33 is deformed quickly and frequently through piezoelectric effect under high frequency during the operation of the piezoelectric pump 3, heats may be generated. Such generated heats may affect the driving frequency of the piezoelectric element 33 in operation, and may be detrimental to the transmitting efficiency. Therefore, in order to improve the above-mentioned issue, a feedback circuit 4 and a measurement chip 6 may be disposed between the microprocessor 1 and the piezoelectric pump 3. Hence, in order to maintain a better driving frequency for the micro piezoelectric pump 100, a frequency chasing action is conducted. Firstly, the microprocessor 1 takes the actuation frequency of the piezoelectric pump 3 as a center frequency fc, and uses the center frequency fc as a reference to space a frequency section before and after to obtain a front frequency ff and a back frequency fb. Then, the measurement chip 6 feedbacks a frequency chasing signal to the microprocessor 1, where the frequency chasing signal includes measured values of the center frequency fc, the front frequency ff, and the back frequency fb. According to the measured values in the frequency chasing signal, the microprocessor 1 determines a better actuation frequency fg from one of the center frequency fc, the front frequency ff, and the back frequency fb. Then, the microprocessor 1 drives the driving frequency output by the driving element 2 to be gradually approached to reach the better actuation frequency fg, so that the driving voltage provided by the driving element 2 to the piezoelectric pump 3 can be consistent with the better actuation frequency fg, thereby avoiding the decrease in transmitting efficiency.

In some embodiments, the frequency chasing signal is an impedance, but is not limited thereto. The measurement chip 6 measures the current and the voltage of the piezoelectric pump 3, and obtains the impedance according to the measurement results. The impedance of the center frequency fc, the impedance of the front frequency ff, and the impedance of the back frequency fb are fed back to the microprocessor 1 as the frequency chasing signal. The microprocessor 1 selects one frequency from the group consisting of the center frequency fc, the front frequency ff, and the back frequency fb. The one which has the lowest impedance may be chosen and taken as the better actuation frequency fg, and then the microprocessor 1 drives the driving element 2 to make the driving frequency consistent with the better actuation frequency fg.

Since the driving frequency of the piezoelectric pump 3 may be affected by the heats generated by the constant operation, the driving frequency cannot be maintained at the aforementioned better actuation frequency $f_g$. Thus, the frequency chasing action may need to be conducted continuously. A new round of the frequency chasing action takes the aforementioned better actuation frequency $f_g$ as a new center frequency $f_{c2}$, and uses the next center frequency $f_{c2}$ as a reference to space a frequency section before and after to obtain a next front frequency $f_{f2}$ and a next back frequency $f_{b2}$ as well. Then, according to the next frequency chasing signal, one of the next center frequency $f_{c2}$, the next front frequency $f_{f2}$, and the next back frequency $f_{b2}$ is selected. Also, the one having the lowest impedance may be selected as a next better actuation frequency $f_{g2}$, and then the microprocessor 1 drives the driving element 2 to make the driving frequency consistent with the next better actuation frequency $f_{g2}$. By repeating the aforementioned frequency chasing action, the driving frequency of the piezoelectric pump 3 can be adjusted constantly and the transmission efficiency is maintained.

Figure 4B:
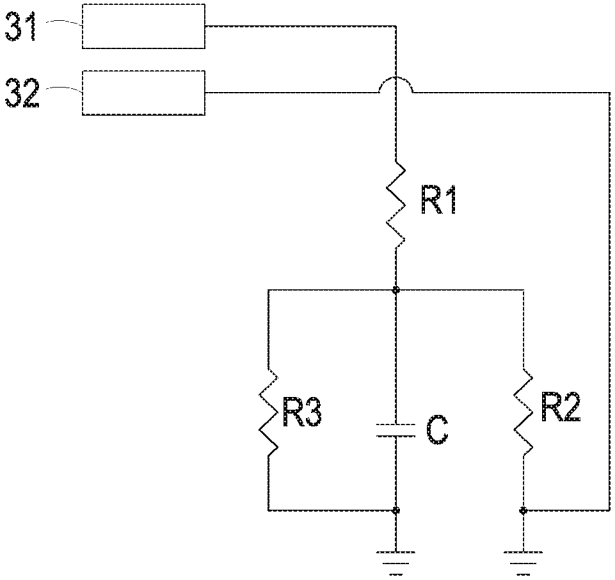
FIG. 4B illustrates an equivalent circuit diagram of the feedback circuit at the second control step according to an exemplary embodiment of the present disclosure.
Figure 4A:
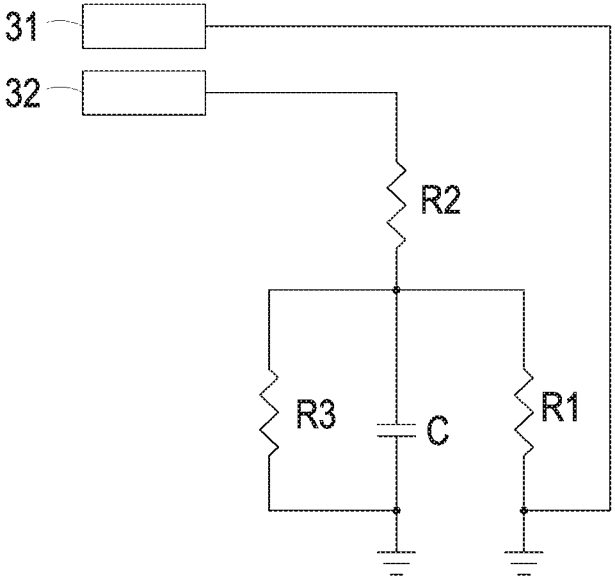
FIG. 4A illustrates an equivalent circuit diagram of the feedback circuit at the first control step according to an exemplary embodiment of the present disclosure.

The feedback circuit 4 continuously receives the state (such as at driving voltage or ground) of the first electrode 31 and the second electrode 32 of the piezoelectric pump 3. In the first control step, the second electrode 32 is at the driving voltage and the first electrode 31 is grounded. At this situation, the equivalent circuit of the feedback circuit 4 is shown in FIG. 4A. The first resistor R1 will be connected in parallel with the third resistor R3. Now, the feedback voltage is (R1//R3)÷[(R1//R3)+R2]×driving voltage. Moreover, in the second control step, the first electrode 31 is at the driving voltage and the second electrode 32 is grounded. At this situation, the equivalent circuit of the feedback circuit 4 is shown in FIG. 4B. The second resistor R2 will be connected in parallel with the third resistor R3. Now, the feedback voltage is (R2//R3)÷[(R2//R3)+R1]×driving voltage. The feedback circuit 4 transmits the feedback voltage to the microprocessor 1. The microprocessor 1 receives the feedback voltage to determine the current driving voltage of the piezoelectric pump 3 and compares the current driving voltage with the modulating signal of the microprocessor 1. If there is a difference between the current driving voltage and the modulating signal, the feedback voltage is converted into a digital signal through the conversion unit 12, and the converted digital modulating signal is transmitted from the communication unit 13 to the communication interface 213*e* to adjust the fifth resistor R5 (may be a digital variable resistor). Finally, the driving voltage output from the voltage output end 211 of the transforming element 21 is divided by the fourth resistor R4 and the fifth resistor R5. The divided driving voltage is fed back to the transforming element 21 through the voltage output end 211 for the transforming element 21 to refer to whether the output driving voltage meets the voltage expected to the modulating signal. If there is a difference between the output driving voltage and the voltage expected to the modulating signal, then the output driving voltage is modulated again. The output driving voltage is adjusted continuously so as to approach closer to reach the driving voltage expected to the modulating signal, and finally the output driving voltage is adjusted to be consistent with the driving voltage expected to the modulating signal. Through the aforementioned steps, the driving voltage received by the piezoelectric pump 3 can meet the voltage expected to the modulating signal of the microprocessor 1. When the voltage value of the driving voltage is the actuation voltage value of the piezoelectric pump 3, the piezoelectric pump 3 has a better transmission efficiency. However, the loss caused by the transmission of the driving voltage and the difficulty of maintaining the driving voltage at the actuation voltage value during the operation will also cause a reduction in transmission efficiency. Therefore, the current driving voltage on the piezoelectric pump 3 can be obtained through the feedback circuit 4. Moreover, through modulating the driving voltage by the transforming element 21, the piezoelectric pump 3 can be kept operating under the actuation voltage value continuously thereby achieving a better transmission efficiency.

Through the feedback circuit 4 and the transforming element 21, the driving voltage of the piezoelectric pump 3 can be controlled accurately. Thus, the microprocessor 1 can adjust the voltage value of the driving voltage accurately. For example, the value of the driving voltage may be controlled at the initial voltage value, the switch-off voltage value, the actuation voltage value, etc. The initial voltage value may be between 3 V and 7 V, and the switch-off voltage value may be between 12 V and 20 V, but is not limited thereto.

In sum, the present application provides a micro piezoelectric pump. According to one or some embodiments of the present disclosure, when the micro piezoelectric pump is switched on, the driving voltage output by the driving element to the piezoelectric pump is the initial voltage value. The driving frequency is adjusted to be consistent with the actuation frequency of the piezoelectric pump under the initial voltage value, so that the piezoelectric pump can start to operate at the initial voltage value. Making the piezoelectric pump start at a lower initial voltage value can reduce the noise of the piezoelectric pump when it is switched on, and can avoid the noise generated when the driving frequency is adjusted to approach closer to reach the actuation frequency of the piezoelectric pump. After the piezoelectric pump is switched on, the driving voltage is then increased from the initial voltage value to reach the actuation voltage value, so that the piezoelectric pump starts to operate efficiently. Moreover, through maintaining the driving frequency at the better actuation frequency by the frequency chasing actions, and through maintaining the driving voltage at the actuation voltage value by the feedback circuit and the transforming element, the piezoelectric pump can keep the better transmission efficiency. When the micro piezoelectric pump is switched off, the driving voltage will be decreased from the actuation voltage value to reach the switch-off voltage value (or the initial voltage value) before stopping the piezoelectric pump, so as to avoid the short noise when the pump is switched off. The above-mentioned micro piezoelectric pump module according to one or some embodiments of the present disclosure can effectively reduce the noise of the piezoelectric pump during the switch-on process and the switch-off process, and can continue to operate at a high efficiency. The industrial value of the present application is extremely high, so the application is submitted in accordance with the law.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A micro piezoelectric pump module, comprising:

a microprocessor outputting a modulating signal and a control signal;

a driving element electrically connected to the microprocessor to receive the modulating signal and the control signal and to output a driving signal, wherein the driving signal comprises a driving voltage and a driving frequency;

a piezoelectric pump electrically connected to the driving element to receive the driving signal, wherein the piezoelectric pump is actuated by the driving signal, and the piezoelectric pump is set to be actuated at an actuation frequency and be applied with a voltage having an actuation voltage value; and a feedback circuit, electrically connected between the piezoelectric pump and the microprocessor and generates a feedback voltage based on the driving voltage output from the driving element to the piezoelectric pump, wherein the feedback voltage is then fed back to the microprocessor, wherein, after receiving a switch-on signal, the microprocessor drives the driving element to output the driving voltage having an initial voltage value to the piezoelectric pump, and makes the driving element gradually adjust the driving frequency of the driving voltage to be the same with the actuation frequency; wherein, after the driving frequency is adjusted to reach the actuation frequency, the microprocessor drives the driving element to gradually increase the initial voltage value to reach the actuation voltage value; and wherein the microprocessor adjusts the driving signal based on the feedback voltage and makes a value of the driving voltage output by the driving element be gradually approached closer to the actuation voltage value until the value of the driving voltage output from the driving element to the piezoelectric pump is the same as the actuation voltage value.

2. The micro piezoelectric pump module according to claim 1, wherein, after receiving a switch-off signal, the microprocessor drives the driving voltage output by the driving element to be gradually decreased from the actuation voltage value to a switch-off voltage value, wherein when the driving voltage of the driving element decreases to the switch-off voltage value, an operation of the driving element is turned off by the microprocessor.

3. The micro piezoelectric pump module according to claim 2, wherein the switch-off voltage value is the initial voltage value.

4. The micro piezoelectric pump module according to claim 3, wherein the initial voltage value is between 3 V and 7 V.

5. The micro piezoelectric pump module according to claim 2, wherein the microprocessor takes the actuation frequency as a center frequency, and uses the center frequency as a reference to space a frequency section before and after thereof to obtain a front frequency and a back frequency, wherein the microprocessor calculates a better actuation frequency by a frequency chasing signal obtained from the front frequency, the center frequency, and the back frequency, whereby the microprocessor adjusts the driving frequency of the driving element to be approached to reach the better actuation frequency.

6. The micro piezoelectric pump module according to claim 5, wherein the microprocessor takes the better actuation frequency as a center frequency and uses the center frequency as a reference to space a frequency section before and after thereof to obtain a front frequency and a back frequency, wherein the microprocessor calculates a better actuation frequency by a frequency chasing signal obtained from the front frequency, the center frequency, and the back frequency, whereby the microprocessor adjusts the driving frequency of the driving element to be approached to reach the better actuation frequency.

7. The micro piezoelectric pump module according to claim 5, a measurement chip is disposed between the piezoelectric pump and the microprocessor, and the frequency chasing signal is transmitted from the piezoelectric pump to the microprocessor through the measurement chip.

8. The micro piezoelectric pump module according to claim 7, wherein the frequency chasing signal is an impedance.

9. The micro piezoelectric pump module according to claim 6, a measurement chip is disposed between the piezoelectric pump and the microprocessor, and the frequency chasing signals are transmitted from the piezoelectric pump to the microprocessor through the measurement chip.

10. The micro piezoelectric pump module according to claim 9, wherein the frequency chasing signals are impedance.

11. The micro piezoelectric pump module according to claim 2, wherein the driving element comprises:

a transforming element receiving the modulating signal so as to output the driving voltage to the piezoelectric pump; and an inverting element receiving the control signal so as to output the driving frequency by the control signal to control the piezoelectric pump.

12. The micro piezoelectric pump module according to claim 1, wherein the driving element comprises a digital variable resistor, and the driving element adjusts the driving voltage value by adjusting the digital variable resistor.

13. The micro piezoelectric pump module according to claim 1, wherein the actuation voltage value is between 12 V and 20 V.

* * * * *